US006144544A

United States Patent [19]

Milov et al.

[11] Patent Number: 6,144,544

[45] **Date of Patent: *Nov. 7, 2000**

[54] APPARATUS AND METHOD FOR MATERIAL TREATMENT USING A MAGNETIC FIELD

[76] Inventors: Vladimir N. Milov, 129164 Prospect Mira d.120, kv.133; Vyacheslav V. Snegirev, 125252 Novopeschanaya d.13/3, kv.216, both of Moscow, Russian Federation

[ * ] Notice: This patent issued on a continued prosecution application filed under 37 CFR 1.53(d), and is subject to the twenty year patent term provisions of 35 U.S.C. 154(a)(2).

[21] Appl. No.: 08/723,603

[22] Filed: Oct. 1, 1996

[51] Int. Cl.[7] ..... H01F 13/00

[52] U.S. Cl. ..... 361/143; 361/149; 361/267

[58] Field of Search ..... 361/143, 149–151, 361/267; 335/284

[56] References Cited

U.S. PATENT DOCUMENTS

| | | | |
|---|---|---|---|
| 306,600 | 3/1990 | Drits et al. | D15/122 |
| 1,978,220 | 10/1934 | Otte | 175/21 |
| 2,856,238 | 10/1958 | Dacus . | |
| 2,984,771 | 5/1961 | Hlavin | 317/157.5 |
| 2,995,701 | 8/1961 | Lloyd | 324/37 |
| 3,038,036 | 6/1962 | Young et al. . | |
| 3,138,494 | 6/1964 | Burket et al. | 148/103 |
| 3,819,402 | 6/1974 | Thrower, Jr. | 117/93.1 DH |
| 3,892,908 | 7/1975 | Lovness | 428/329 |
| 3,946,125 | 3/1976 | Scheiber | 427/46 |
| 3,963,533 | 6/1976 | Collins | 148/108 |
| 4,033,795 | 7/1977 | Berry et al. | 148/108 |
| 4,212,688 | 7/1980 | Makino et al. | 148/31.55 |
| 4,262,035 | 4/1981 | Jaeger et al. | 427/39 |
| 4,268,325 | 5/1981 | O'Handley et al. | 148/108 |
| 4,273,800 | 6/1981 | Reid | 427/47 |
| 4,283,438 | 8/1981 | Lee | 427/47 |
| 4,379,004 | 4/1983 | Makino et al. | 148/108 |
| 4,419,383 | 12/1983 | Lee | 427/47 |
| 4,473,415 | 9/1984 | Ochiai et al. | 148/108 |
| 4,492,845 | 1/1985 | Kljuchko et al. | 219/121 P |
| 4,537,850 | 8/1985 | Smeiman | 430/137 |
| 4,551,221 | 11/1985 | Axemov et al. | 204/298 |
| 4,560,521 | 12/1985 | Walling et al. | 264/24 |

(List continued on next page.)

FOREIGN PATENT DOCUMENTS

| | | | |
|---|---|---|---|
| 1317205 | 5/1993 | Canada | 148/7 |
| 30 45 703 | 7/1982 | Germany . | |
| 42 21 058 | 1/1994 | Germany . | |

(List continued on next page.)

OTHER PUBLICATIONS

L.N. Romashov et al., "Effect of Pulse Magnetic Field On Martensitic Transformation In Low Carbon Cr–Ni Steel", *Fisica Metallov and Metallovedenie,* 1984, 57 v. 4, pp. 768–775 (in Russian).

R. F. Hochman, V. Drits, N. Tselesin: *Surface Modification by Magnetic Treatment*; Encyclopedia of Materials Science and Engineering; Supplementary vol. 3, Pergamon Press, pp. 2037–2041 (Robert W. Cahn FRS, Michael B. Bever eds.). No date provided.

R. F. Hochman, N. Tselesin, V. Drits; *Magnetic Fields: Fertile Ground For Metals Processing*; Advanced Materials & Processes; Magnetic Processing Systems, Inc.; Reprint of an article Aug. 1988.

Supplementary European Search Report, Application No. EP 97 90 9870, dated Feb. 2000.

*Primary Examiner*—Fritz Fleming
*Attorney, Agent, or Firm*—Dorsey & Whitney LLP

[57] ABSTRACT

A method and apparatus for treating an object includes generating a magnetic field wherein at least some of the magnetic field is characterized by changes in amplitude of the magnetic field from an average non-zero value of the magnetic field. The object is placed in the influence of the magnetic field for a sufficient time to subject the object to the changes in amplitude of the magnetic field. A method and apparatus for determining a preferred field intensity of the magnetic field is also included.

27 Claims, 8 Drawing Sheets

U.S. PATENT DOCUMENTS

| | | | |
|---|---|---|---|
| 4,614,929 | 9/1986 | Tsukuda et al. | 361/143 |
| 4,639,278 | 1/1987 | Makino et al. | 148/108 |
| 4,668,365 | 5/1987 | Foster et al. | 204/192.23 |
| 4,782,293 | 11/1988 | Steingroever et al. | 335/284 |
| 4,816,965 | 3/1989 | Drits | 361/267 |
| 4,873,605 | 10/1989 | Drits et al. | 361/267 |
| 5,032,792 | 7/1991 | Wing et al. | 361/149 |
| 5,126,669 | 6/1992 | Honess et al. | 361/149 |
| 5,493,275 | 2/1996 | Easter | 361/267 |
| 5,495,230 | 2/1996 | Lian | 361/149 |
| 5,557,493 | 9/1996 | Ross | 361/149 |

FOREIGN PATENT DOCUMENTS

| | | |
|---|---|---|
| 56-44746 | 4/1981 | Japan . |
| 60-26647 | 2/1985 | Japan . |
| 62-5989 | 2/1987 | Japan . |
| 485155 | 12/1975 | Russian Federation . |
| 2047005 | 11/1980 | United Kingdom . |

APPARATUS AND METHOD FOR MATERIAL TREATMENT USING A MAGNETIC FIELD

BACKGROUND OF THE INVENTION

The present invention relates to treatment of a material utilizing magnetic fields. More particularly, the present invention relates to treating materials utilizing a pulsed magnetic field.

Recently, there has been a growing interest in using magnetic fields to alter the physical, chemical and mechanical properties of materials. For example, by applying a constant magnetic field, fundamental changes in the material substructure have been indicated. These changes can provide improved stress relief, improved room-temperature fatigue properties, as well as changes in fundamental diffusion behavior and thermal dynamic properties.

U.S. Pat. No. 4,873,605 describes an apparatus and method for treating ferromagnetic materials using pulsed magnetic fields. The apparatus includes a coil into which the material to be treated is inserted. A controlled source of electrical power generates a magnetic field on the interior of the coil for achieving a pulsed magnetic field. This magnetic field, depending on the number of cycles, the length of pauses between the cycles, and the amplitude or power of the magnetic field is used to treat material. The cycle length is usually about 15 seconds to 50 seconds.

Although techniques have been utilized for treating materials with pulsed magnetic fields, there is an ongoing need to further optimize this treatment to increase the speed and efficiency of the treatment.

SUMMARY OF THE INVENTION

One aspect of the present invention is a method and apparatus of treating an object including generating a magnetic field wherein at least some of the magnetic field is characterized by changes in amplitude of the magnetic field from an average non-zero value of the magnetic field. The object is placed in the influence of the magnetic field for a sufficient time to subject the object to the changes in amplitude of the magnetic field.

A second aspect of the present invention is a method for determining a preferred field intensity used in a pulsed magnetic field treatment. The method includes the steps of generating a magnetic field having an intensity varying with time; placing an object in the influence of the magnetic field; obtaining selective values indicative of a magnetic susceptibility of the object; and ascertaining the preferred field intensity as a function of the selected values obtained.

DETAILED DESCRIPTION OF THE PREFERRED EMBODIMENTS

Figure 1:
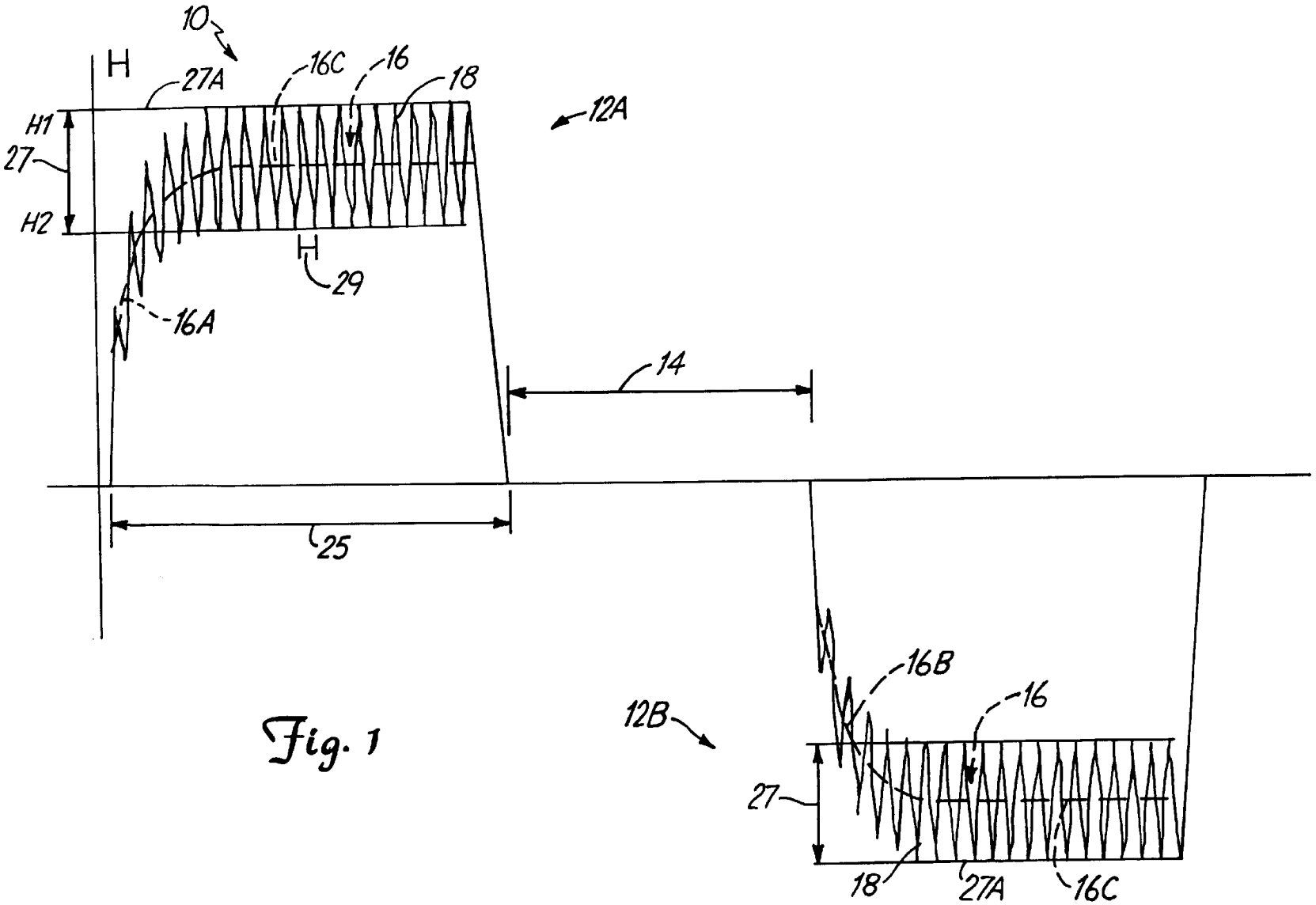
FIG. 1 is a graphical representation of magnetic field pulses according to the present invention.

FIG. 1 graphically illustrates a first embodiment of a method of material treatment using a magnetic field 10 of the present invention. Generally, the magnetic field 10 includes at least one and preferably a plurality of magnetic field pulses 12A and 12B separated by a time indicated by double arrow 14 wherein a magnetic field is not applied. As illustrated, preferably, each magnetic field pulse 12A and 12B can be characterized by the superposition of a static magnetic field indicated by a dashed line 16 with an alternating magnetic field indicated at 18. In other words, the magnetic field pulses 12A and 12B each can be characterized by applying the alternating magnetic field 18 for a selected time duration such that the amplitude of the resultant magnetic field changes with time from an average non-zero value 16 of the magnetic field.

As used herein, "static" and "average non-zero value" include time varying portions of field 16 such as indicated at 16A and 16B and is not limited to only substantially constant portions such as indicated at 16C.

It has been discussed such as in U.S. Pat. No. 4,873,605, which is hereby incorporated by reference, that by subjecting a material to a pulsed magnetic field redistributes internal stresses within the material. By redistributing the stresses, characteristics of the material can be changed. For example, a pulsed magnetic field through a tool provides relief of the residual stresses from manufacturing and sharpening and may increase strength and surface hardness, decreases the coefficient of friction on the surfaces that are so treated, and provides an increase in the modulus of elasticity, therefore providing for increased tool life. Generally, all of the material properties and characteristics which are affected by elastic strain in the structure may also be affected by the magnetic field treatment of the present invention. This means that the magnetic field treatment of the present invention can be expected to indirectly influence fundamental material behavior in many applications such as those involving dimensional stability, corrosion, wear and friction, fatigue, hysteresis loss, diffusion, phase transformations and coating adherence. The material to be treated with the present invention can be either metallic or non-metallic (i.e. semiconductor). This invention influences both magnetic and non-magnetic materials and treatable materials can be characterized as ferromagnetic, ferrimagnetic, antiferromagnetic, paramagnetic and diamagnetic.

Prior art applications of pulsed magnetic fields such as disclosed in U.S. Pat. No. 4,873,605 involved pulses having substantially static or constant amplitude during application of the field. One aspect of the present invention includes varying the amplitude of the magnetic field using, for example, a repeating waveform 18 to vary the amplitude of the magnetic field from the average non-zero or static value 16. Application of the pulsed magnetic field 10 of the present invention efficiently and more effectively redistributes the stresses within the material being treated.

Figure 2:
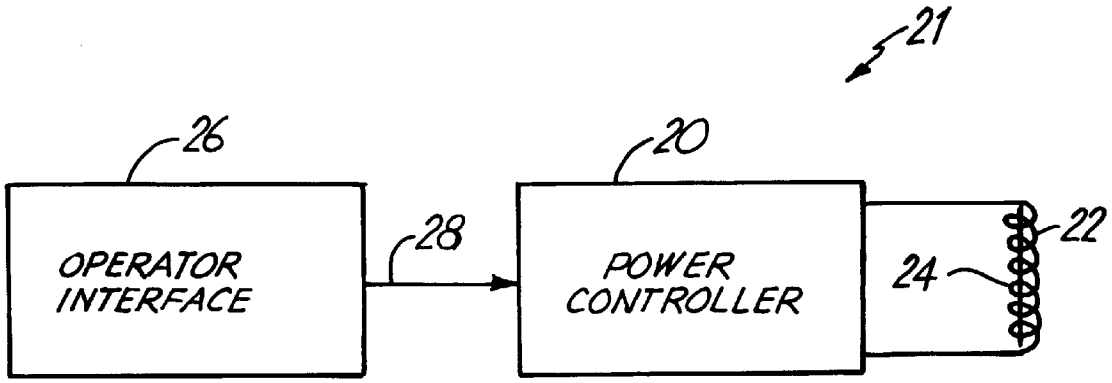
FIG. 2 is a schematic representation of an apparatus to produce the magnetic field pulses.
Figure 3:
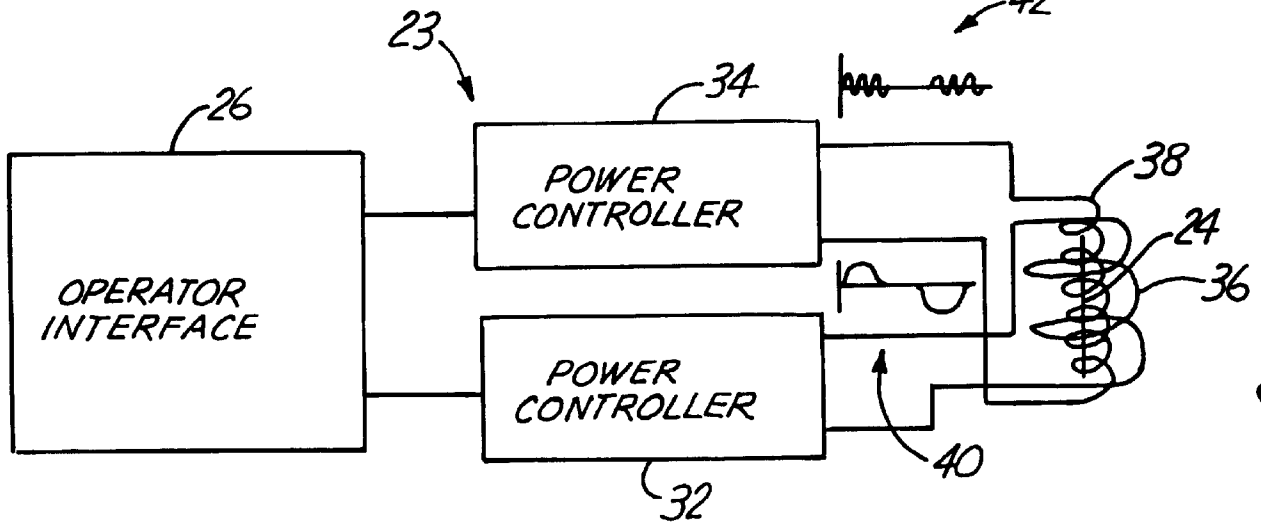
FIG. 3 is a schematic representation of a second embodiment of an apparatus to produce the magnetic field pulses.

FIGS. 2 and 3 illustrate alternative apparatuses 21 and 23, respectively, for generating the pulsed magnetic field 10 of FIG. 1. In FIG. 2, a power controller 20 controls the current through or the voltage applied to a single coil 22. The coil 22 generates the pulse magnetic field 10 as a function of the electrical power provided by the controller 20. An object or a material 24 to be treated is placed within the coil 22, as illustrated, or sufficiently proximate to, in order that the pulsed magnetic field 10 passes through the object 24. Preferably, an operator interface 26 provides suitable control signals on a signal line 28 to vary parameters of the pulsed magnetic field 10. Referring back to FIG. 1, the parameters include the amplitude of the average non-zero value 16 of each pulse, a duration 25 of each pulse, the time duration 14 between pulses or series of pulses (if two or more pulses are applied sequentially), an amplitude 27 of the alternating magnetic field 18 and a time period 29 between cycles of the alternating magnetic field 18. Generally, the resultant amplitude of the magnetic field 10 is dependent on the material to be treated. In addition, the lower the frequency of the pulses 12A, 12B or the longer the duration 25 of each pulse 12A, 12B, the deeper the treatment within the object. Typically, the amplitude 27 of the alternating magnetic field 18 is 50% of the maximum indicated at 27A in FIG. 1 and the frequency of the alternating magnetic field 18 is 50% of the frequency of the pulses 12A, 12B, wherein a minimum frequency of the pulses 12A, 12B is limited by the inductance of the coil 22. If desired, after applications of the pulsed magnetic field 10, the object can be demagnetized using known demagnetization methods.

However, it should be understood that FIG. 1 is just an example of superposition of the alternating magnetic field 18 with the static field 16. If desired, the alternating magnetic field 18 can be applied for a time duration less than time duration 25 with application of the alternating magnetic field 18 starting and stopping at any selected time within time duration 25. Likewise, the frequency and amplitude of the alternating magnetic field 18 and the static magnetic field 16 can vary during time duration 25.

In FIG. 3, the apparatus 23 for generating the pulsed magnetic field 10 of FIG. 1 includes power controllers 32 and 34, and coils 36 and 38. Unlike the apparatus 21 illustrated in FIG. 2 that generates the pulsed magnetic field 10 through the single coil 22, the apparatus 23 of FIG. 3 combines the magnetic fields of coils 36 and 38 to realize the desired pulsed magnetic field 10 of FIG. 1. In the embodiment illustrated, the coil 36 is connected to the power controller 32. The power controller 32 provides electrical power to the coil 36 in order to realize the average non-zero magnetic field indicated in FIG. 1 at 16. The power controller 32 generates the average non-zero magnetic field 16 using pulses indicated at 40 in FIG. 3, having a relatively large amplitude and low frequency.

The coil 38 is connected to the power controller 34. The power controller 34 controls power to the coil 38 such that a current flowing in the coil 38 alternates, having, as compared to the pulse 40, a relatively low amplitude and high frequency as indicated at 42. Application of current from the power controllers 32 and 34 to the coils 36 and 38, respectively, are controlled to coincide with each other such that magnetic fields therefrom superimpose with each other to realize the magnetic field pulse 10 of FIG. 1. The coils 36 and 38 can be intertwined with each other, as illustrated, or alternatively, the coils 36 and 38 can be concentrically positioned about the object 24.

Figure 4:
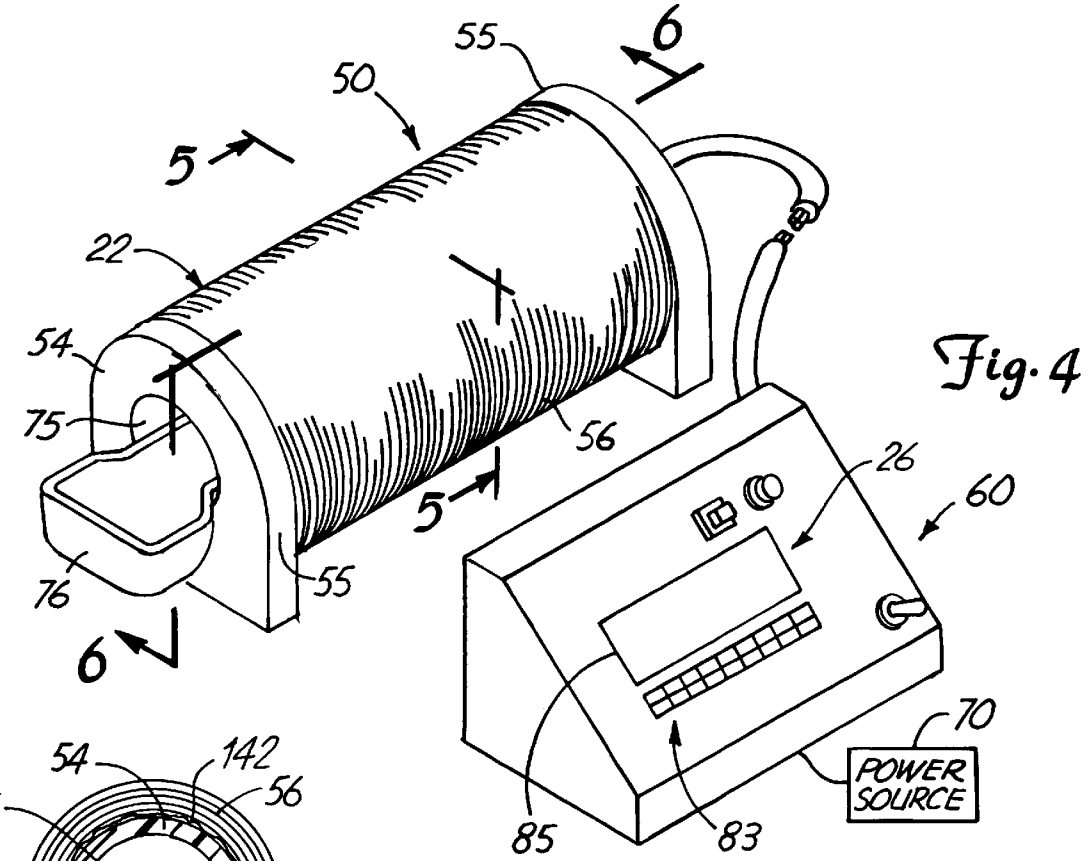
FIG. 4 is a perspective representation of a device made according to the present invention showing a workpiece holding tray.
Figure 5:
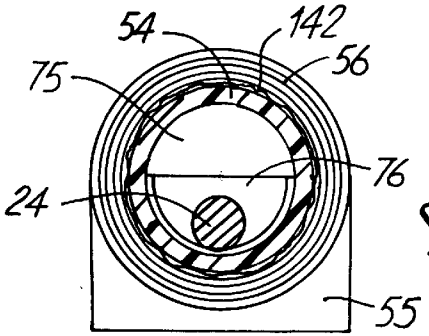
FIG. 5 is vertical sectional view of the device of FIG. 4 taken along lines 5—5 in FIG. 4.
Figure 6:
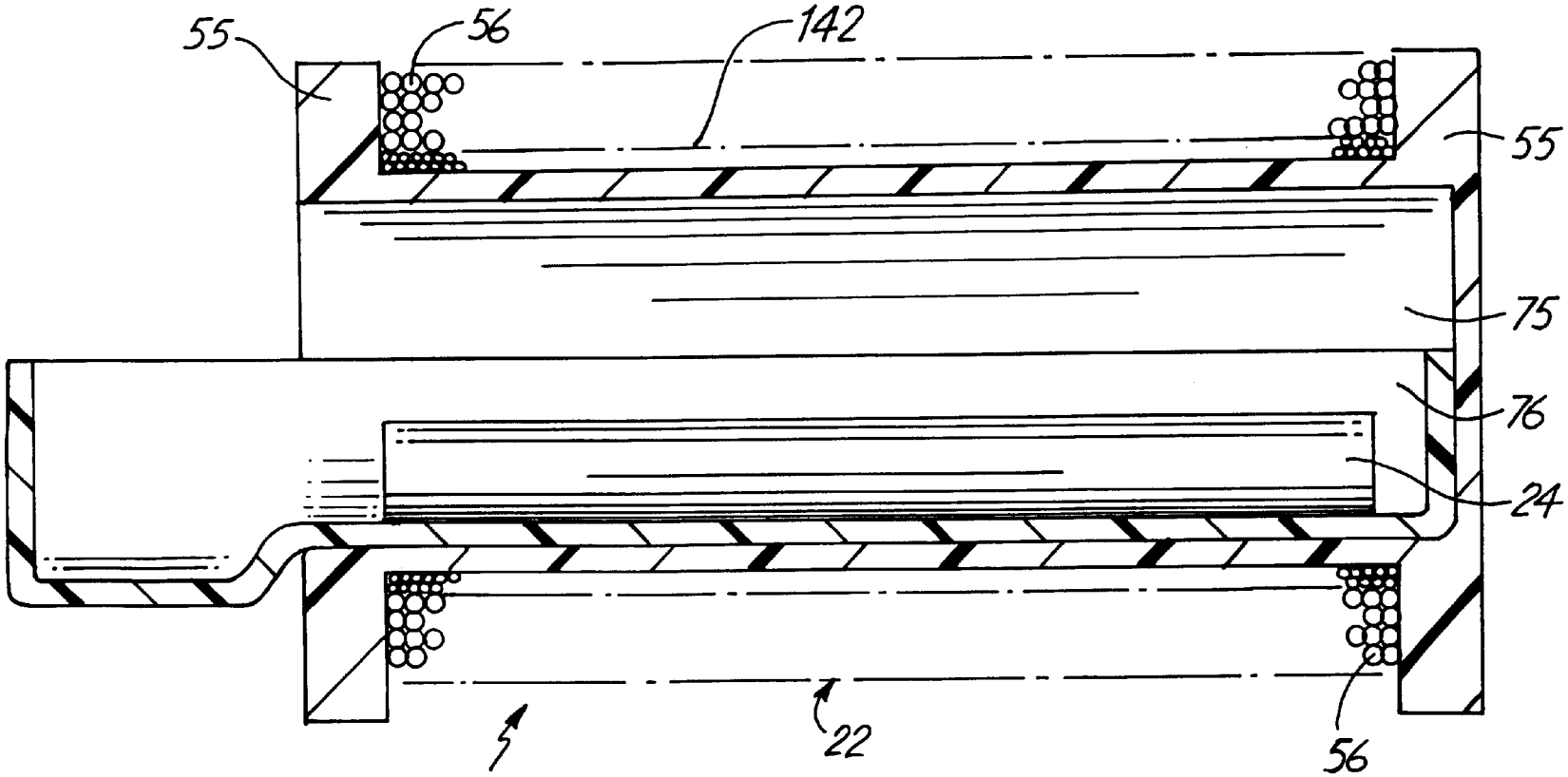
FIG. 6 is a sectional view taken along lines 6—6 in FIG. 4.

FIGS. 4, 5 and 6 further illustrate the apparatus 21 of FIG. 2. The apparatus 21 includes a frame 50, on which the coil 22 is mounted. The coil 22, as shown, has a central core 54 and end flanges 55. The coil 22 is formed of suitable wire and has a necessary number of turns 56 wound around the core 54 and between the flanges 55 to generate the desired magnetic field strength. The coil 22 is connected to a power assembly 60 having the power controller 20, the operator interface 26, and a suitable power source 70. The power assembly 60 provides current to the coil 22 having a desired waveform in order to generate the pulsed magnetic field 10 of FIG. 1.

In the embodiment illustrated, the core 54 has an internal opening 75 in which an object holding drawer 76 is slidably mounted therein. The drawer 76 can be of any desired configuration, but generally is of a non-magnetic material so that the magnetic field generated by the coil 22 will pass through the object 24. If desired, the drawer 76 can be omitted or replaced with a suitable fixture to hold the object 24. In another embodiment, a transport mechanism such as a conveyor can be used to bring many objects into and out of the coil 22 such as on a manufacturing line.

It should be understood that the apparatus 21 described above having the coil 22 is but one suitable magnetic field generating device for practicing the present invention. Other known magnetic field generating devices can be used to produce a magnetic field of the present invention exemplified in FIG. 1 having desired field directional and intensity characteristics. For example, a directional coil can be used in place of the conventional coil 22.

The controller 20 is operated to provide current through the coil 22 to create a magnetic field through the object 24. The magnetic field, depending on the number of cycles, the length of pauses between cycles, if the cycles are repeated, and the amplitude or power of the magnetic field, will be used to treat the object 24. The parameters, discussed above, can be varied through the use of the operator interface 26. The cycle length is usually about 5 seconds to 2 minutes, but the treatment can be lengthened or shortened. Experimentation for a particular object made from a particular material geometric can be carried out to achieve desired results. Likewise, the orientation of the object within the coil 22 can be changed to achieve desired results.

Figure 7:
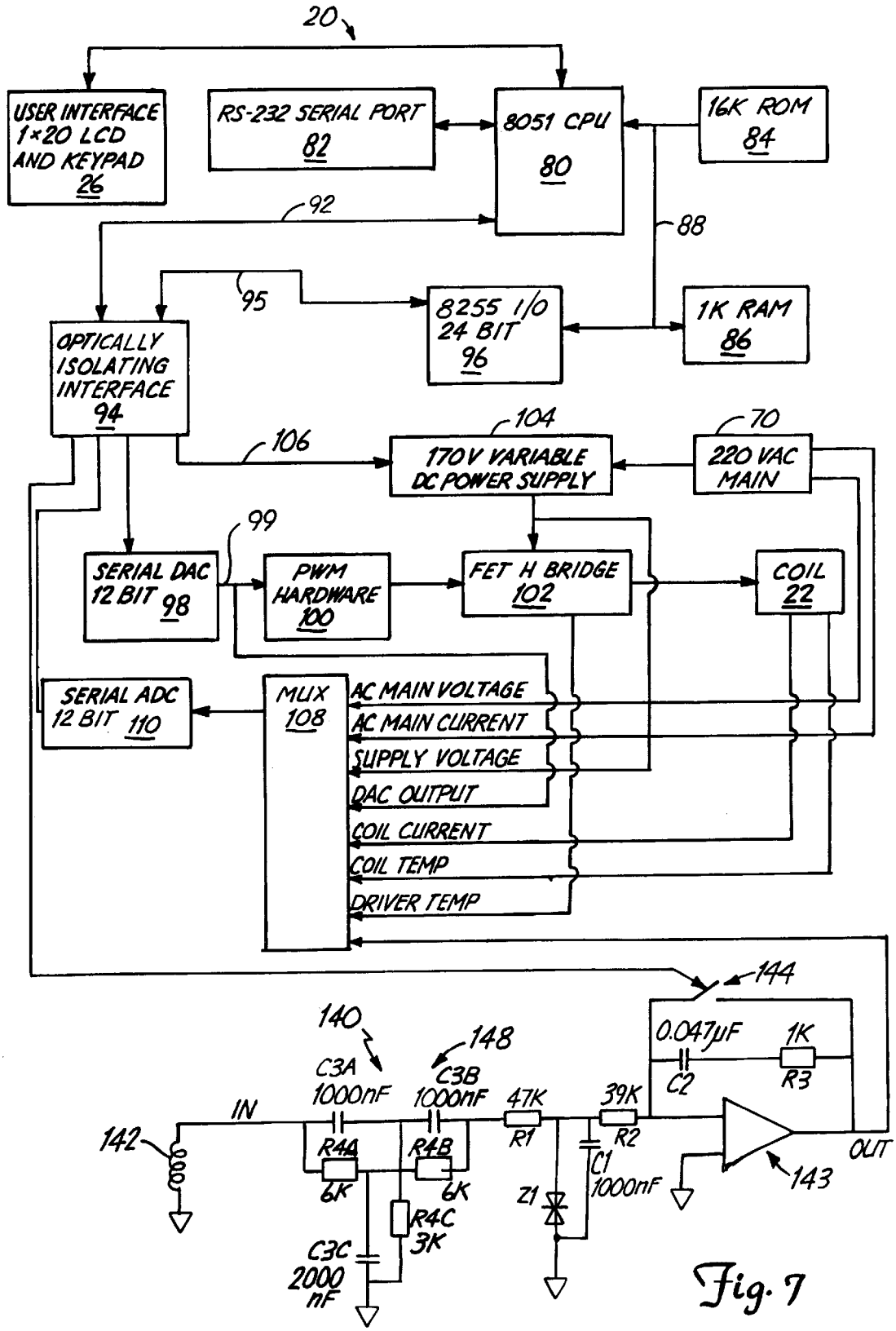
FIG. 7 is a block diagram of the apparatus of FIG. 2.

FIG. 7 illustrates, in block diagram form, an embodiment of the power controller 20 operably connected to the operator interface 26 and the coil 22. The power controller 20 includes a microprocessor 80 operably connected to the operator interface 26 directly, or through a RS-232 serial port 82. Typically, the user interface 26 includes a keypad 83 and a suitable display 85 such as a liquid crystal display (FIG. 4). The microprocessor 80 communicates with read-only-memory (ROM) 84 and random-access memory (RAM) through a bus 88. The ROM 84 stores a suitable program executed by the microprocessor 80 to obtain user commands and parameter settings from the operator interface 26 and generate current control signals through components discussed below to realize the pulsed magnetic field 10 of FIG. 1. The RAM 86 provides temporary storage of intermediate variables used by the microprocessor 80 in executing the program stored in ROM 84. The RAM 86 also stores the user setable parameters discussed above.

Output commands from the microprocessor 80 and feedback data indicating operation of the apparatus 21 are provided through ports on the microprocessor 80 indicated at 92 to a suitable optically isolating interface 94 providing optical isolation between current controlling components of the power controller 20 and the microprocessor 80. In view that the number of ports available on the microprocessor 80 are not sufficient to control all aspects of the apparatus 21, additional ports 95 are provided through an input-output buffer indicated at 96 that is connected to the bus 88. Output commands from the microprocessor 80 are provided through the optically isolating interface 94 to a serial digital-to-analog converter 98. The digital-to-analog converter 98 provides a corresponding analog control signal 99 to a pulse width modulator 100. The pulse width modulator 100, in turn, provides control signals to gates of power FET transistors connected conventionally in a H-bridge configuration indicated at 102. The power transistors 102 receive power from a DC power supply 104. The control signals received from the pulse width modulator 100 control the power transistors 102 to vary the voltage across the coil 22 and thereby control the current in order to realize the pulsed magnetic field 10 of FIG. 1.

In the embodiment illustrated, alternating current is provided to the DC power supply 104 from the AC source 70. The DC power supply 104 typically includes SCRs to rectify the AC power provided by the power source 70. Gate triggers for the SCRs of the power supply 104 are provided through the optically isolating interface 94 as indicated at 106.

Feedback of the operating status of the apparatus 21 is provided through a MUX 108 and a serial analog-to-digital converter 110. Preferably, the AC voltage and current from the power source 70 are monitored to determine if boundary thresholds have been exceeded. Likewise, the output voltage from the DC power supply 104 that is provided to the power transistors 102 is also monitored. To ensure that the digital-to-analog converter 98 is operating correctly, the MUX 108 receives the output signal 99 from the digital-to-analog converter 98. Current provided to the coil 22 from the power transistors 102 is monitored and provides feedback to the microprocessor to ensure that the proper current waveform is being generated. In addition, the temperature of the coil 22 and power components of the power transistors 102 are monitored in order that operating limits are not exceeded.

Another aspect of the present invention includes selecting a preferred value for the magnetic field strength of a pulsed magnetic field such as illustrated in FIG. 1 at 10. The preferred value of the magnetic field may vary, due to the type of material and the shape of the object to be treated.

Referring to FIG. 7, a circuit for obtaining a signal indicative of the magnetic susceptibility of the object 24 to be treated is indicated at 140. The circuit 140 includes a pick-up coil 142 and an integrator circuit 143. The integrator circuit 143 is controlled through a switch 144 by the microprocessor 80 according to a data acquisition program stored in ROM 84 and discussed below. As illustrated, control signals for the switch 144 can be optically isolated from the microprocessor 80 using the optically isolating interface 94. As discussed below, an output signal 146 is periodically obtained from the integrator circuit 143. The output signal 146 can be provided back to the microprocessor 80 using the MUX 108 and the analog-to-digital converter 110.

In the embodiment illustrated, an additional passive RC circuit R1C1 is used to minimize the influence of high frequencies present in the pick-up coil 142. In order to compensate for the integration effect of the passive RC circuit R1C1, an additional R3 is connected in series with a main integration capacitor C2. To compensate for double integration, the value of R1C1 must be approximately equal to the value of R3C2. When the switch 144 is closed, the integrator circuit 143 is reset. Integration occurs when the switch 144 is open.

In the embodiment illustrated, a rejection filter 148 comprising resistors R4A, R4B, R4C and capacitors C3A, C3B and C3C is used to decrease any error produced by high frequency noise from the pulse width modulator 100. A zener diode Z1 protects the integration circuit 143 from large voltage spikes.

Referring to FIGS. 5 and 6, the pick-up coil 142 is concentrically disposed between the coil 22 and the object 24 to be tested.

Figure 8:
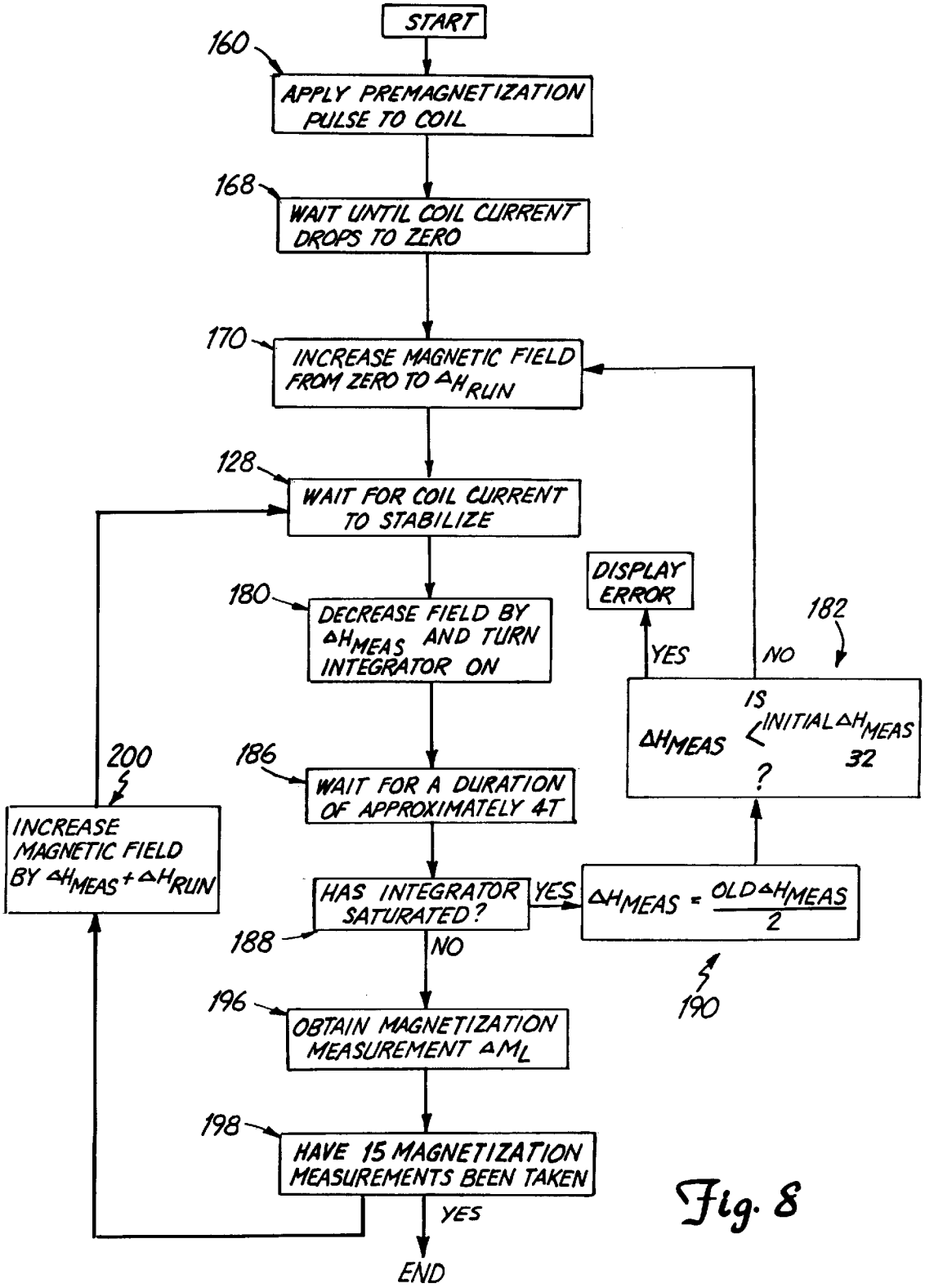
FIG. 8 is a flow diagram of a method for obtaining magnetic field data for calculating a preferred magnetic field intensity for pulsed magnetic field treatment.
Figure 9:
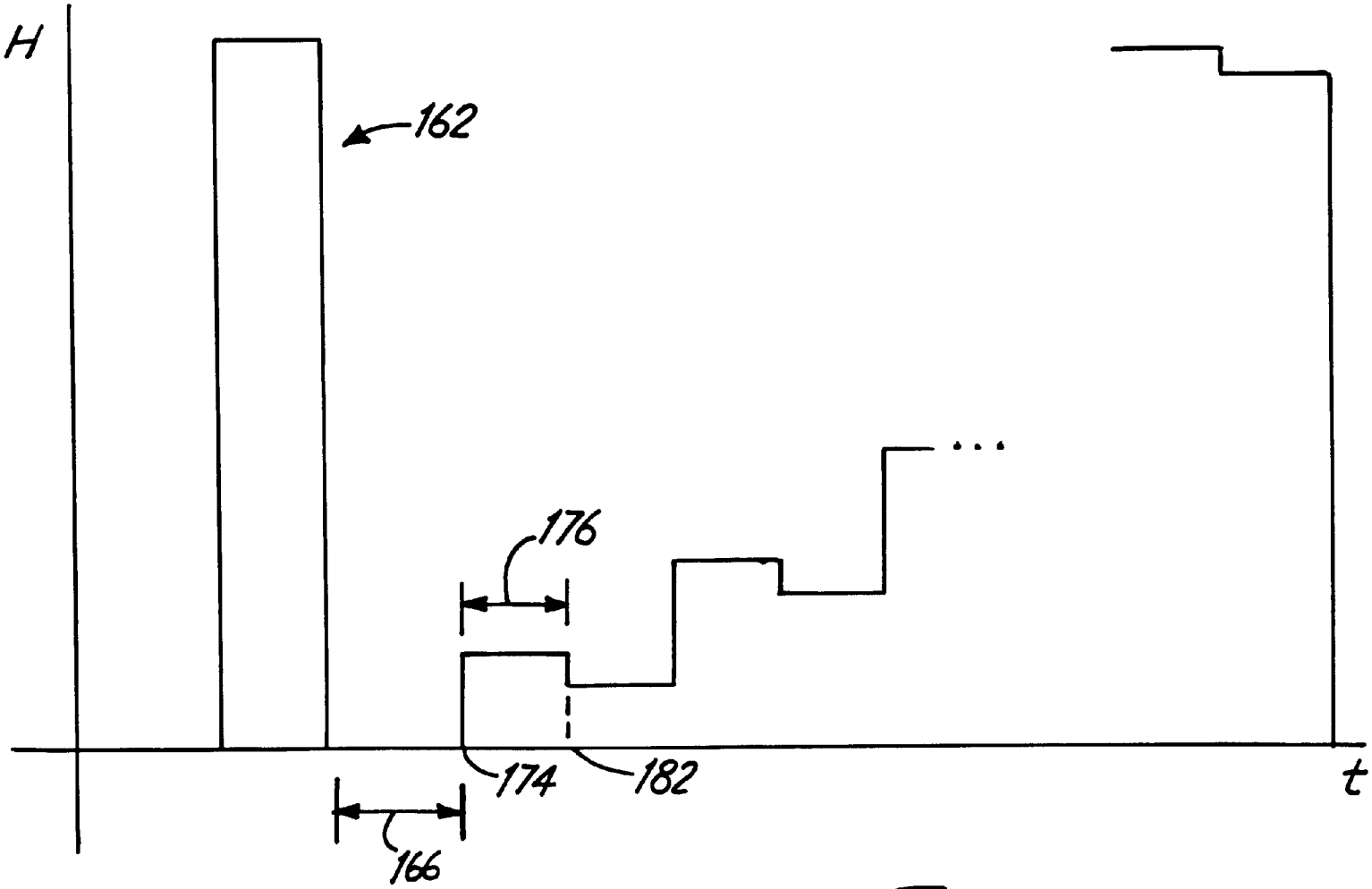
FIG. 9 is a graphical representation of FIG. 8.
Figure 10:
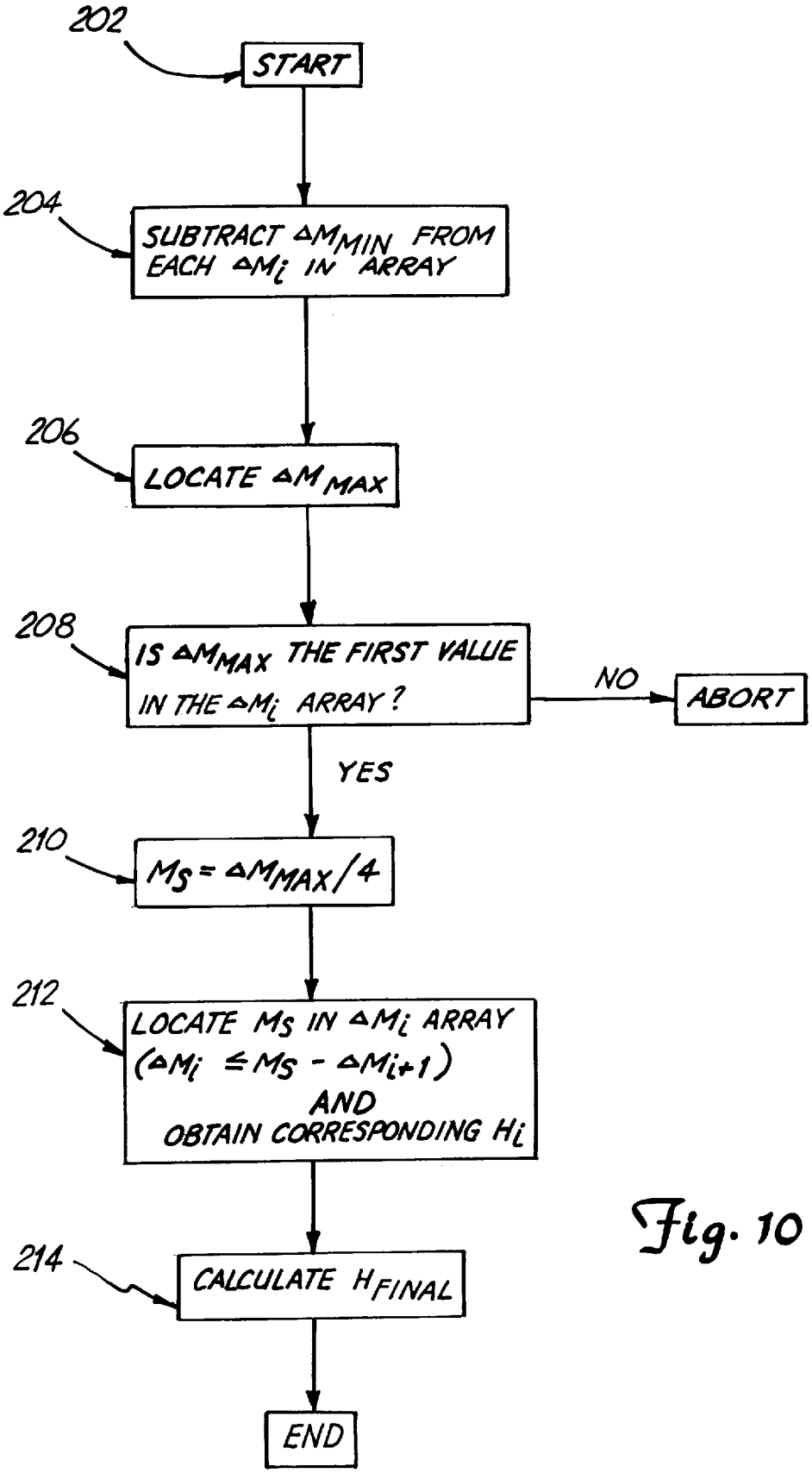
FIG. 10 is a flow diagram of a method for calculating a preferred magnetic field intensity for pulsed magnetic field treatment.

A method for determining a preferred intensity of the field from the coil 22 for a given object is illustrated in FIGS. 8–10. FIG. 8 and 9 illustrate a method for obtaining an array of values indicative of the magnetic susceptibility of the object 24, while FIG. 10 illustrates a method of analyzing the collected magnetic field values to obtain the preferred magnetic strength value to be generated by the coil 22.

Beginning at step 160 in FIG. 8 and with additional reference to FIG. 9, a premagnetization pulse 162 is generated in the coil 22 and through the object 24 to be tested. Preferably, the premagnetization pulse 162 is at the maximum field strength obtainable from the coil 22 and is used to remove any magnetic "history" present in the object 24. The duration of the premagnetization pulse 162 depends on the size of the coil 22 present in the apparatus 21. A suitable duration is approximately equal to four times a value of the time constant for the coil 22 (T=L/R) where L is the inductance of the coil 22 and R is the resistance of the coil 22. After the premagnetization pulse 162 is removed, the current in the coil 22 is allowed to reach zero during a time period 166 (approximately 4T) as represented in FIG. 8 at step 168.

Obtaining values indicative of magnetic susceptibility begins at step 170. As will be explained below, preferably, an array of values indicative of magnetic susceptibility are obtained. In the method illustrated, 15 values are obtained.

At step 170 in FIG. 8 and at time 174 in FIG. 9, the coil 22 is energized to obtain an increase in field strength by a value $\Delta H_{run}$. In the method illustrated, $\Delta H_{run}$ should not exceed $H_{max}/15$, where $H_{max}$ is the maximum field strength obtainable from the coil 22. A time period 176 is allowed to lapse at step 178 in order that the current in coil 22 stabilizes. During steps 170 and 178, the integrator circuit 143 is held in reset.

At step 180 in FIG. 8 and at time 182 in FIG. 9, magnetic field strength of the coil 22 is decreased by a value $\Delta H_{meas}$ and simultaneously the switch 144 is opened to allow integration of the signal from the pick-up coil 142. Integration continues at step 186 for a duration approximately equal to 4T.

At step 188, the output signal 146 from the integration circuit 143 is analyzed to determine if the integrator circuit 143 has saturated. If the integrator circuit 143 has saturated, the method of data acquisition continues to step 190 where $\Delta H_{meas}$ is decreased by a factor of two. At step 192, the new $\Delta H_{meas}$ is compared to the initial $\Delta H_{meas}$ divided by 32. If the current $\Delta H_{meas}$ is less than the initial $\Delta H_{meas}$ divided by 32 an error signal is displayed and acquisition is aborted. Otherwise, acquisition begins again at step 170 or step 160, depending on if any magnetic history should be removed.

If the integrator circuit 143 has not saturated as detected at step 188, a value indicative of magnetization susceptibility ($\Delta M_i$) is obtained at step 196. As stated above, 15 values are obtained in the method illustrated. Step 198 determines if all 15 values have been obtained. If 15 values have not been obtained, the magnetic field of the coil 22 is increased by the amount of $\Delta H_{meas}+\Delta H_{run}$ at step 200 and the method returns to step 178. Once 15 values of $\Delta M_i$ are collected, acquisition is complete and analysis begins at step 202 in FIG. 10.

Each $\Delta M_i$, in the array collected using the method of FIG. 8 has a corresponding field strength $H_i$. FIG. 10 illustrates a method of obtaining a preferred value for the field strength of the coil strength using the array of $\Delta M_i$. At step 204, a minimum value $\Delta M_{min}$ in the array of $\Delta M_i$ is located and subtracted from each $\Delta M_i$ in the array. At step 206, the maximum value $\Delta M_{max}$ value is then located in the $\Delta M_i$ array. If the $\Delta M_{max}$ value is not the first value in the array, analysis is aborted as represented at step 208. Otherwise, a value $M_s$ is calculated at step 210 using $\Delta M_{max}$. The position of $M_s$ in the array $\Delta M_i$ is determined at step 212 in order to obtain the corresponding $H_i$.

Preferably, in order to reduce any possible fluctuation of an optimum value for the field strength of the coil 22 due to a relatively flat shape of the $\Delta M(H)$ curve, the value obtained at step 212 is modified by the following equation (represented at step 214 in FIG. 10):

$$H_{final} = H_i + kH_i\left(1 - \frac{H_i}{H_{\max}}\right)$$

where k is an experimentally determined coefficient approximately equal to 0.7; and $H_{max}$ is the maximum field strength obtainable from the coil 22.

Although the present invention has been described with reference to preferred embodiments, workers skilled in the art will recognize that changes may be made in form and detail without departing from the spirit and scope of the invention.

What is claimed is:

1. A method of treating an object having internal stresses in its structure that affect at least one of its properties, comprising the steps of:

generating a magnetic field comprising a plurality of magnetic field pulses separated by a time of not generating a magnetic field wherein at least some of the magnetic field pulses are characterized by changes in amplitude of the magnetic field from an average non-zero value of the magnetic field, the time of not generating the magnetic field being related to a type of material and the internal stresses in the structure; and controlling the magnetic field pulse and the time of not generating the magnetic field such that when an object is placed in the influence of the magnetic field pulse for a sufficient time the magnetic field pulse alters the object's internal stresses in order to modify at least one of the object's properties.

2. The method of claim 1 wherein the changes in amplitude of the magnetic field comprise a repeating waveform having a selected frequency.

3. The method of claim 2 wherein the plurality of magnetic field pulses have a selected frequency.

4. The method of claim 3 wherein the selected frequency of the repeating waveform is greater than the selected frequency of the magnetic field pulses.

5. The method of claim 1 wherein the material comprises a ferromagnetic material.

6. The method of claim 1 wherein the material comprises a diamagnetic material.

7. The method of claim 1 wherein the material comprises a paramagnetic material.

8. The method of claim 1 wherein the material comprises a ferrimagnetic material.

9. The method of claim 1 and further comprising the step of demagnetizing the object after the step of placing.

10. The method of claim 1 and further comprising the step of determining a preferred field intensity of the magnetic field as a function of a magnetic susceptibility of the object.

11. The method of claim 10 wherein the step of determining a preferred field intensity includes applying an increasing magnetic field.

12. The method of claim 11 wherein the increasing magnetic field comprises discrete time periods of a substantially constant magnetic field, wherein a level of the magnetic field increases with each subsequent discrete time period.

13. The method of claim 12 wherein the increasing magnetic field comprises a succeeding discrete time period of a reduced magnetic field following each of the first-mentioned discrete time periods.

14. The method of claim 13 and further including sensing the magnetic field during each succeeding discrete time period of a reduced magnetic field.

15. The method of claim 14 wherein the step of sensing includes a pick-up coil providing an output signal.

16. The method of claim 15 and further including integrating the output signal.

17. An apparatus for treating an object having internal stresses in its structure that affect at least one of its properties, comprising:

a magnetic field generating device; and a controller for operating the magnetic field generating device to produce a magnetic field comprising a plurality of magnetic field pulses separated by a time of not generating a magnetic field, the time of not generating the magnetic field being related to a type of material and the internal stresses in the structure, wherein at least some of the magnetic field pulses are characterized by changes in amplitude of the magnetic field from an average non-zero value of the magnetic field, the magnetic field pulses being sufficient to alter an object's internal stresses to modify at least one of the object's properties.

18. The apparatus of claim 17 wherein the changes in amplitude of the magnetic field comprise a repeating waveform having a selected frequency.

19. The apparatus of claim 18 wherein the plurality of magnetic field pulses have a selected frequency.

20. The apparatus of claim 19 wherein the selected frequency of the repeating waveform is greater than the selected frequency of the magnetic field pulses.

21. A method for determining a preferred field intensity used in a magnetic field treatment of an object having internal stresses in its structure that affect at least one of its properties, the method comprising the steps of:

generating a magnetic field having an intensity varying with time, the magnetic field comprising a plurality of magnetic field pulses separated by a time of not generating a magnetic field, the time of not generating the magnetic field being related to the internal stresses in the structure;

obtaining selected values related to a magnetic susceptibility of the object; and ascertaining the preferred field intensity as a function of the selected values obtained; whereby the field intensity is sufficient to alter the object's internal stresses to modify at least one of the object's properties.

22. The method of claim 21 wherein the intensity of the magnetic field increases with time.

23. The method of claim 22 wherein the step of obtaining includes sensing the magnetic field with a pick-up coil.

24. The method of claim 23 wherein the step of obtaining includes integrating an output signal of the pick-up coil.

25. The method of claim 22 wherein the increasing magnetic field comprises discrete time periods of a substantially constant magnetic field, wherein a level of the magnetic field increases with each subsequent discrete time period.

26. The method of claim 25 wherein the increasing magnetic field comprises a succeeding discrete time period of a reduced magnetic field following each of the first-mentioned discrete time periods.

27. The method of claim 26 and further including sensing the magnetic field during each succeeding discrete time period of a reduced magnetic field.

* * * * *

UNITED STATES PATENT AND TRADEMARK OFFICE

CERTIFICATE OF CORRECTION

PATENT NO. : 6,144,544
DATED : November 7, 2000
INVENTOR(S) : Vladimir N. Milov et al.

It is certified that error appears in the above-identified patent and that said Letters Patent is hereby corrected as shown below:

Column 1,
Lines 36-51, delete the text and replace it with the following:

A method and apparatus consistent with the present invention generate a magnetic field for use in relieving internal stresses of a material. The magnetic field includes a plurality of static magnetic field pulses and an alternating magnetic field superimposed on each of the plurality of static magnetic field pulses. A period of zero feld separates each of the plurality of superimposed static magnetic field pulses.

Column 7, Line 33 to Column 10, Line 7 (Claims 1-27) delete the text and replace it with the following:

1. A method for generating a magnetic field for use in relieving internal stresses of a material, comprising:

generating a plurality of static magnetic field pulses;

superimposing on each of the plurality of static magnetic field pulses an alternating magnetic field; and separating each of the plurality of superimposed static magnetic field pulses by a period of zero field, wherein application of the magnetic field to a material relieves internal stresses in the material.

2. The method of claim 1, further including varying, based upon the material, an amplitude of the alternating magnetic field, a frequency of the alternating magnetic field, or a duration of the period of zero field.

3. The method of claim 1 wherein the generating step includes generating a plurality of positive static magnetic field pulses.

4. The method of claim 1 wherein the generating step includes generating a plurality of negative static magnetic field pulses.'

5. The method of claim 1 wherein the generating step includes generating a positive static magnetic field pulse and a negative static magnetic field pulse.

6. The method of claim 3 wherein the superimposing step includes generating the alternating magnetic field having an amplitude equal to approximately fifty percent of a maximum amplitude of the alternating magnetic field.

7. The method of claim 4 wherein the superimposing step includes generating the alternating magnetic field having an amplitude equal to approximately fifty percent of a minimum amplitude of the alternating magnetic field.

UNITED STATES PATENT AND TRADEMARK OFFICE

CERTIFICATE OF CORRECTION

PATENT NO. : 6,144,544
DATED : November 7, 2000
INVENTOR(S) : Vladimir N. Milov et al.

It is certified that error appears in the above-identified patent and that said Letters Patent is hereby corrected as shown below:

8. The method of claim 1 wherein the superimposing step includes generating the alternating magnetic field having a frequency equal to approximately double a frequency of the static magnetic field pulses.

9. A method for treating a material using a magnetic field in order to relieve internal stresses of the material, comprising:

applying to the material a plurality of static magnetic field pulses with an alternating magnetic field superimposed each of the plurality of static magnetic field pulses; and separating the application of each of the plurality of superimposed static magnetic field pulses by a period of zero field, wherein the application of the magnetic field to the material relieves internal stresses in the material.

10. The method of claim 9, further including varying, based upon the material, an amplitude of the alternating magnetic field, a frequency of the alternating magnetic field, or a duration of the period of zero field.

11. The method of claim 9 wherein the applying step includes applying to the material a plurality of positive static magnetic field pulses.

12. The method of claim 9, wherein the applying step includes applying to the material a plurality of negative static magnetic field pulses.

13. The method of claim 9 wherein the applying step includes applying to the material a positive static magnetic field pulse and a negative static magnetic field pulse.

14. The method of claim 11 wherein the applying step includes applying to the material the alternating magnetic field having an amplitude equal to approximately fifty percent of a maximum amplitude of the alternating magnetic field.

15. The method of claim 12 wherein the applying step includes applying to the material the alternating magnetic field having an amplitude equal to approximately fifty percent of a minimum amplitude of the alternating magnetic field.

16. The method of claim 9 wherein the applying step includes applying to the material the alternating magnetic field having a frequency equal to approximately double a frequency of the static magnetic field pulses.

17. The method of claim 9 wherein the applying step includes applying the superimposed static magnetic field pulses to a magnetic material.

UNITED STATES PATENT AND TRADEMARK OFFICE

CERTIFICATE OF CORRECTION

PATENT NO. : 6,144,544
DATED : November 7, 2000
INVENTOR(S) : Vladimir N. Milov et al.

It is certified that error appears in the above-identified patent and that said Letters Patent is hereby corrected as shown below:

18. The method of claim 9 wherein the applying step includes applying the superimposed static magnetic field pulses to a non-magnetic material.

Signed and Sealed this

Fifth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,144,544 
DATED : November 7, 2000
INVENTOR(S) : Vladimir N. Milov et al.

It is certified that error appears in the above-identified patent and that said Letters Patent is hereby corrected as shown below:

Column 1,
Lines 36-51, delete the text and replace it with the following:

A method and apparatus consistent with the present invention generate a magnetic field for use in relieving internal stresses of a material. The magnetic field includes a plurality of static magnetic field pulses and an alternating magnetic field superimposed on each of the plurality of static magnetic field pulses. A period of zero feld separates each of the plurality of superimposed static magnetic field pulses.

Column 7, Line 33 to Column 10, Line 7 (Claims 1-27) delete the text and replace it with the following:

1. A method for generating a magnetic field for use in relieving internal stresses of a material, comprising:

generating a plurality of static magnetic field pulses;

superimposing on each of the plurality of static magnetic field pulses an alternating magnetic field; and separating each of the plurality of superimposed static magnetic field pulses by a period of zero field, wherein application of the magnetic field to a material relieves internal stresses in the material.

2. The method of claim 1, further including varying, based upon the material, an amplitude of the alternating magnetic field, a frequency of the alternating magnetic field, or a duration of the period of zero field.

3. The method of claim 1 wherein the generating step includes generating a plurality of positive static magnetic field pulses.

4. The method of claim 1 wherein the generating step includes generating a plurality of negative static magnetic field pulses.'

5. The method of claim 1 wherein the generating step includes generating a positive static magnetic field pulse and a negative static magnetic field pulse.

6. The method of claim 3 wherein the superimposing step includes generating the alternating magnetic field having an amplitude equal to approximately fifty percent of a maximum amplitude of the alternating magnetic field.

CERTIFICATE OF CORRECTION

PATENT NO. : 6,144,544
DATED : November 7, 2000
INVENTOR(S) : Vladimir N. Milov et al.

It is certified that error appears in the above-identified patent and that said Letters Patent is hereby corrected as shown below:

7. The method of claim 4 wherein the superimposing step includes generating the alternating magnetic field having an amplitude equal to approximately fifty percent of a minimum amplitude of the alternating field.

8. The method of claim 1 wherein the superimposing step includes generating the alternating magnetic field having a frequency equal to approximately double a frequency of the static magnetic field pulses.

9. A method for treating a material using a magnetic field in order to relieve internal stresses of the material, comprising:

applying to the material a plurality of static magnetic field pulses with an alternating magnetic field superimposed each of the plurality of static magnetic field pulses; and separating the application of each of the plurality of superimposed static magnetic field pulses by a period of zero field, wherein the application of the magnetic field to the material relieves internal stresses in the material.

10. The method of claim 9, further including varying, based upon the material, an amplitude of the alternating magnetic field, a frequency of the alternating magnetic field, or a duration of the period of zero field.

11. The method of claim 9 wherein the applying step includes applying to the material a plurality of positive static magnetic field pulses.

12. The method of claim 9, wherein the applying step includes applying to the material a plurality of negative static magnetic field pulses.

13. The method of claim 9 wherein the applying step includes applying to the material a positive static magnetic field pulse and a negative static magnetic field pulse.

14. The method of claim 11 wherein the applying step includes applying to the material the alternating magnetic field having an amplitude equal to approximately fifty percent of a maximum amplitude of the alternating magnetic field.

15. The method of claim 12 wherein the applying step includes applying to the material the alternating magnetic field having an amplitude equal to approximately fifty percent of a minimum amplitude of the alternating magnetic field.

It is certified that error appears in the above-identified patent and that said Letters Patent is hereby corrected as shown below:

16. The method of claim 9 wherein the applying step includes applying to the material the alternating magnetic field having a frequency equal to approximately double a frequency of the static magnetic field pulses.

17. The method of claim 9 wherein the applying step includes applying the superimposed static magnetic field pulses to a magnetic material.

18. The method of claim 9 wherein the applying step includes applying the superimposed static magnetic field pulses to a non-magnetic material.

19. An apparatus for generating a magnetic field for use in relieving internal stresses of a material, comprising:

a coil; and a power controller coupled to the coil, the power controller operating to generate through the coil a plurality of static magnetic field pulses, an alternating magnetic field superimposed on each of the plurality of static magnetic field pulses, and a period of zero field separating each of the plurality of superimposed static magnetic field pulses, wherein application of the magnetic field to a material relieves internal stresses in the material.

20. The apparatus of claim 19 wherein the power controller operates to vary, based upon the material, an amplitude of the alternating magnetic field, a frequency of the alternating magnetic field, or a duration of the period of zero field.

21. The apparatus of claim 19 wherein the power controller operates to generate a plurality of positive static magnetic field pulses.

22. The apparatus of claim 19 wherein the power controller operates to generate a plurality of negative static magnetic field pulses.

23. The apparatus of claim 19 wherein the power controller operates to generate a positive static magnetic field pulse and a negative static magnetic field pulse.

24. The apparatus of claim 21 wherein the power controller operates to generate the alternating magnetic field having an amplitude equal to approximately fifty percent of a maximum amplitude of the alternating magnetic field.

UNITED STATES PATENT AND TRADEMARK OFFICE

CERTIFICATE OF CORRECTION

PATENT NO. : 6,144,544
DATED : November 7, 2000
INVENTOR(S) : Vladimir N. Milov et al.

It is certified that error appears in the above-identified patent and that said Letters Patent is hereby corrected as shown below:

25. The apparatus of claim 22 wherein the power controller operates to generate the alternating magnetic field having an amplitude equal to approximately fifty percent of a minimum amplitude of the alternating magnetic field.

26. The apparatus of claim 19 wherein the power controller operates to generate the alternating magnetic field having a frequency equal to approximately double a frequency of the static magnetic field pulses.

This certificate supersedes Certificate of Correction issued February 5, 2002.

Signed and Sealed this

Nineteenth Day of November, 2002

*Attest:*

*Attesting Officer*

JAMES E. ROGAN
*Director of the United States Patent and Trademark Office*